US006877610B2

(12) United States Patent
Boast

(10) Patent No.: US 6,877,610 B2
(45) Date of Patent: Apr. 12, 2005

(54) SCREEN ASSEMBLY

(75) Inventor: Ian Boast, Burton on Trent (GB)

(73) Assignee: BL-Pegson Ltd. (GB)

( * ) Notice: Subject to any disclaimer, the term of this patent is extended or adjusted under 35 U.S.C. 154(b) by 0 days.

(21) Appl. No.: 10/357,738

(22) Filed: Feb. 4, 2003

(65) Prior Publication Data

US 2003/0146315 A1 Aug. 7, 2003

(30) Foreign Application Priority Data

Feb. 6, 2002 (GB) ..... 0202706

(51) Int. Cl.[7] ..... B07B 1/49

(52) U.S. Cl. ..... 209/405; 209/257; 209/260; 209/404; 209/420; 209/421; 209/412; 241/89; 241/89.1; 241/89.2; 241/101.74

(58) Field of Search ..... 209/257, 260, 209/261, 404, 413, 412, 420, 421; 241/89, 89.1, 89.2, 101.71, 101.75, 101.74, 68, 69, 75, 76, 79, 80

(56) References Cited

U.S. PATENT DOCUMENTS 3,402,816 A * 9/1968 Taylor ..... 209/260
3,439,806 A * 4/1969 Kass ..... 209/260
4,383,651 A * 5/1983 Couperus ..... 241/81
5,112,474 A * 5/1992 Douglas ..... 209/240
5,460,332 A * 10/1995 Frick ..... 241/101.74
5,577,618 A * 11/1996 Rafferty ..... 209/421
5,797,666 A * 8/1998 Park ..... 312/319.5
5,860,533 A * 1/1999 Wood ..... 209/308
5,878,967 A * 3/1999 Conner ..... 241/79.1
6,186,338 B1 * 2/2001 Douglas ..... 209/421
6,405,874 B1 * 6/2002 Douglas ..... 209/421

FOREIGN PATENT DOCUMENTS

GB 2 223 963 4/1990

OTHER PUBLICATIONS

Copy of search report for United Kingdom dated Aug. 8, 2002.

* cited by examiner

*Primary Examiner*—Donald P. Walsh
*Assistant Examiner*—Jonathan R. Miller
(74) *Attorney, Agent, or Firm*—Young & Basile, P.C.

(57) ABSTRACT

A screen assembly 22 includes a conveyor 26 pivotably mounted beneath a screen 24 for segregation of fractions of material, for example from a mobile crusher 10. Hydraulic cylinders (not shown) are used to selectively move telescopic arms 48 (only one of which is shown in the Figures), to raise or lower the conveyor 26 between operative position and inoperative positions. In the operative position the conveyor 26 is substantially parallel to the screen 24 for receiving material which has passed through the screen mesh, in use. In the inoperative position the conveyor 26 is angularly displaced relative to the screen 24 about the pivot, to provide access to the underside of the screen 24, e.g. for maintenance purposes. Removable pins 50 are provided for releasably securing the attitude of the conveyor 26 relative to the screen 24 in the operative position.

10 Claims, 4 Drawing Sheets

SCREEN ASSEMBLY

BACKGROUND OF THE INVENTION

The present invention relates to a screen assembly for a material processing plant, more particularly, but not exclusively, to a screen assembly for a mobile crusher.

A mobile crusher is a mobile processing plant often used in the trituration of quarried materials e.g. stone. Mobile crushers are also used in the processing of aggregate from concrete or masonry waste, for example. A typical mobile crusher includes a chassis having a motor-driven crushing tool for crushing material, a hopper for feeding material to be crushed into the crushing tool, and a primary discharge conveyor for discharging crushed material which passes through the crushing tool.

The mobile crusher may include a screen assembly having one or more screens for discharging different fractions of the crushed material from the crushing tool. A screen is a device for the segregation of a material into products of different sized particles. Typically, a screen consists of a mesh mounted on a frame, which is supported on springs and fitted with an unbalanced drive, such that the screen can be vibrated to aid the passage of a predetermined size of material through the mesh.

On a mobile crusher, a screen assembly is mounted with a screen arranged beneath the primary conveyor at an angle to the horizontal. In use, crushed material is fed by the conveyor onto the upper end of the screen, such that the crushed material passes down over the vibrating screen mesh. Thus, particles of the crushed material smaller than the mesh openings are able to drop through the screen, typically on to a secondary discharge conveyor for stock piling. The particles of crushed material which do not pass through the mesh continue to travel down the screen until they are discharged, typically onto a further conveyor. The further conveyor may consist of a recirculating conveyor, for returning the oversize particles to the crushing tool, or a conveyor for discharging the oversize particles to a predetermined stock pile, for example.

The particles which pass through the screen mesh are either fed onto a second screen mounted directly below the first screen and having a smaller mesh opening size for segregation into smaller sizes, or onto a further secondary discharge conveyor, for example to be discharged on a predetermined stock pile.

Where a screen assembly is provided on a mobile crusher, it is important to be able to gain access to both the top deck and underside of the or each screen, for maintenance purposes. For example, it may be necessary to repair a damaged mesh or to change the mesh for another having a different size mesh opening. It is also desirable to be able to alter the angle at which a screen is inclined in use, to optimise efficiency of the screening process.

Unfortunately, due to the limited space available on a mobile crusher of the type described above, the or each screen is usually disposed between the primary discharge conveyor and the secondary discharge conveyor. Hence, access to the or each screen is restricted, which can lead to maintenance problems. Commonly, this is overcome by mounting a screen and an associated secondary conveyor on separate supporting frames, pivoted on the plant chassis about the lower ends of the frames, with the upper ends of each frame supported on pairs of cylinders. This arrangement enables the upper ends of each frame to be raised or lowered separately relative to one another. Access to the underside of a screen is therefore gained by lowering the secondary conveyor only, and access to the top deck of the screen is gained by lowering both the secondary conveyor and screen together.

However, this known solution is still restrictive. Moreover, there is an increasing need to reduce the weight of processing plant, such as mobile crushers, for transportation on public roads. Undesirably, the use of additional supporting frameworks for the raising or lowering of screens and conveyors, as described above, increases the already substantial weight of the mobile crusher, which is typically between 40 to 75 tonnes (metric tons).

It is an object of the invention to reduce, or substantially obviate, the disadvantages referred to above.

SUMMARY OF THE INVENTION

According to the present invention, there is provided a screen assembly for a material processing plant comprises:

a screen having a mesh for segregation of fractions of material placed thereon;

a conveyor pivotably mounted beneath the screen, the conveyor being movable between an operative position in which the conveyor is disposed substantially parallel to the screen, for receiving material which has passed through the screen, in use, and an inoperative position in which the conveyor is angularly displaced about the pivot, for access to be provided to the underside of the screen; and means for releasably securing the attitude of the conveyor relative to the screen in the operative position.

The pivotable connection between the screen and conveyor is preferably provided at respective ends of the screen and conveyor, such that, in the inoperative position, the free ends of the screen and conveyor are displaced away from one another, to allow substantially maximum access to the underside of the screen.

The means for releasably securing the attitude of the conveyor relative to the screen in the operative position preferably consists of at least one connecting member having two ends, one end connected to the conveyor and the other end connected to the screen, and at least one end of the connecting member being releasably connectable to the conveyor or screen respectively.

The means for releasably securing the attitude of the conveyor relative to the screen may include at least one removable pin.

Conveniently, the screen assembly includes means for connecting the screen assembly to a material processing plant.

The screen assembly may include a subframe connectable to a material processing plant, for mounting the screen assembly on the plant.

Preferably, the screen assembly is pivotably mounted on the means for connecting the screen assembly to a material processing plant, for pivotable movement of the screen assembly relative to the plant, in use.

The means for connecting the screen assembly to a material processing plant may include at least one telescopic member having two ends, one end of the at least one telescopic member being connected to the screen assembly, and the other end of the at least one telescopic member being connectable to the material processing plant, for raising or lowering one end of the screen assembly relative to the plant.

Preferably, the at least one telescopic member includes a hydraulic cylinder for selectively moving the telescopic member between an extended position and a retracted position.

The underside of the screen assembly may include a support member for supporting the screen assembly in a lowered position, in use.

DESCRIPTION OF THE DRAWINGS

The invention will now be described, by way of example only, with reference to the accompanying drawings, in which.

DETAILED DESCRIPTION

Figure 1:
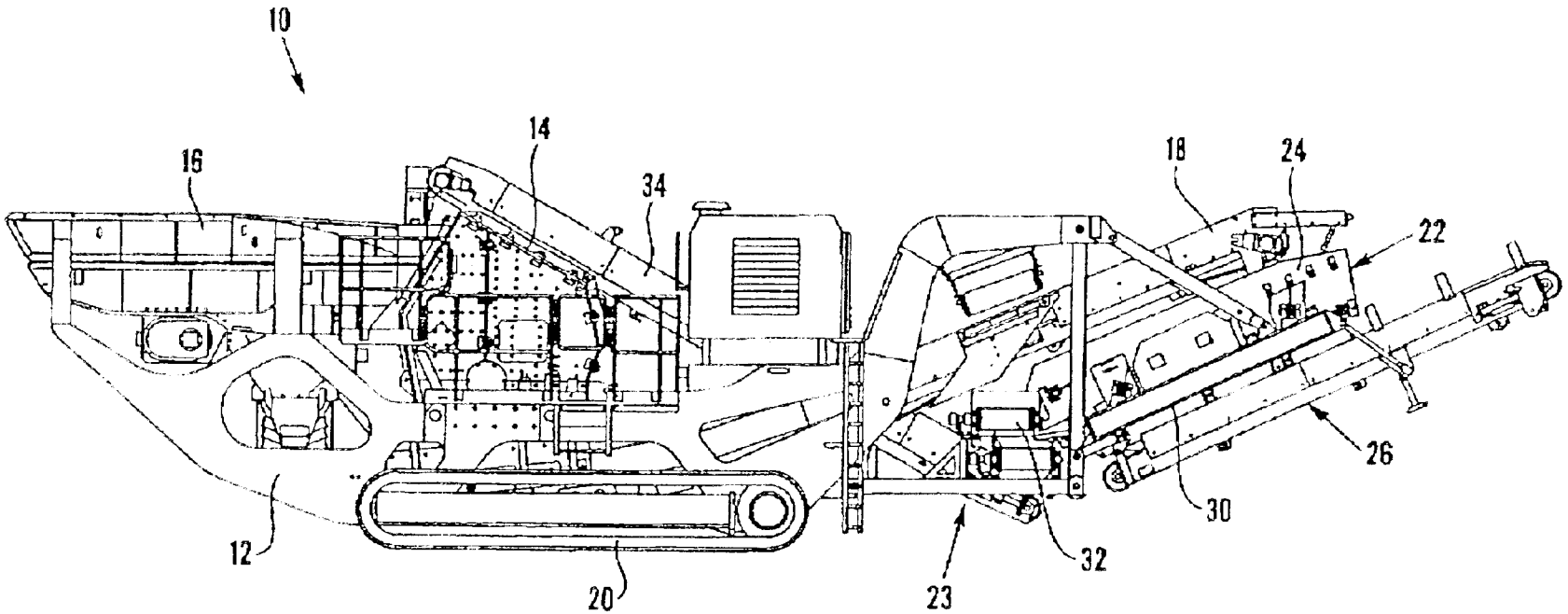
FIG. 1 is a side view showing a mobile crusher incorporating a screen assembly according to the invention in an operative position.

Referring to FIG. 1, a mobile crusher is indicated generally at 10 and includes a chassis 12 having a motor-driven crushing tool 14 for crushing material, a hopper 16 for feeding material to be crushed into the crushing tool 14, and a primary discharge conveyor 18 for discharging the crushed material. The chassis 12 is connected to a tracked undercarriage 20 to enable the mobile crusher 10 to be moved around a quarry, for example.

The mobile crusher 10 is provided with screen assembly indicated at 22 mounted on the chassis 12 by means of a subframe 23 on the opposite side of the crushing tool 14 to the hopper 16. The screen assembly 22 includes a screen 24 for segregating fractions of crushed material, and a secondary discharge conveyor 26. The screen 24 is of a known construction having a mesh (not visible) mounted on a frame 30, which is fitted with an unbalanced drive 32, for vibrating the screen 24, in use. The mobile crusher 10 also includes a recirculating conveyor 34 in communication with the screen assembly.

All of the conveyors mentioned in the above description are endless belt conveyors.

In use, material to be crushed, e.g. stone material produced from a quarry, is placed in the hopper 16 and fed into the crushing tool 14 where it is crushed. Crushed material passes through the crushing tool 14 onto the primary discharge conveyor 18 and thence to the upper end of the primary discharge conveyor 18.

In the operative position, as shown, the screen 24 is disposed at an angle to the horizontal and crushed material is fed from the primary discharge conveyor 18 onto the upper end of the screen 24. The crushed material is passed onto the vibrating screen mesh. Thus, particles of the crushed material smaller than the mesh openings are able to drop through the screen 24 on to the secondary discharge conveyor 26. The oversize particles of crushed material remaining on the screen mesh continue to travel down the screen 24 until they are discharged onto the recirculating conveyor 34. The recirculating conveyor 34 returns the oversize particles to the crushing tool 14 for re-processing. The smaller sized particles travel up the secondary discharge conveyor 26 to be discharged for stock piling.

Figure 2:
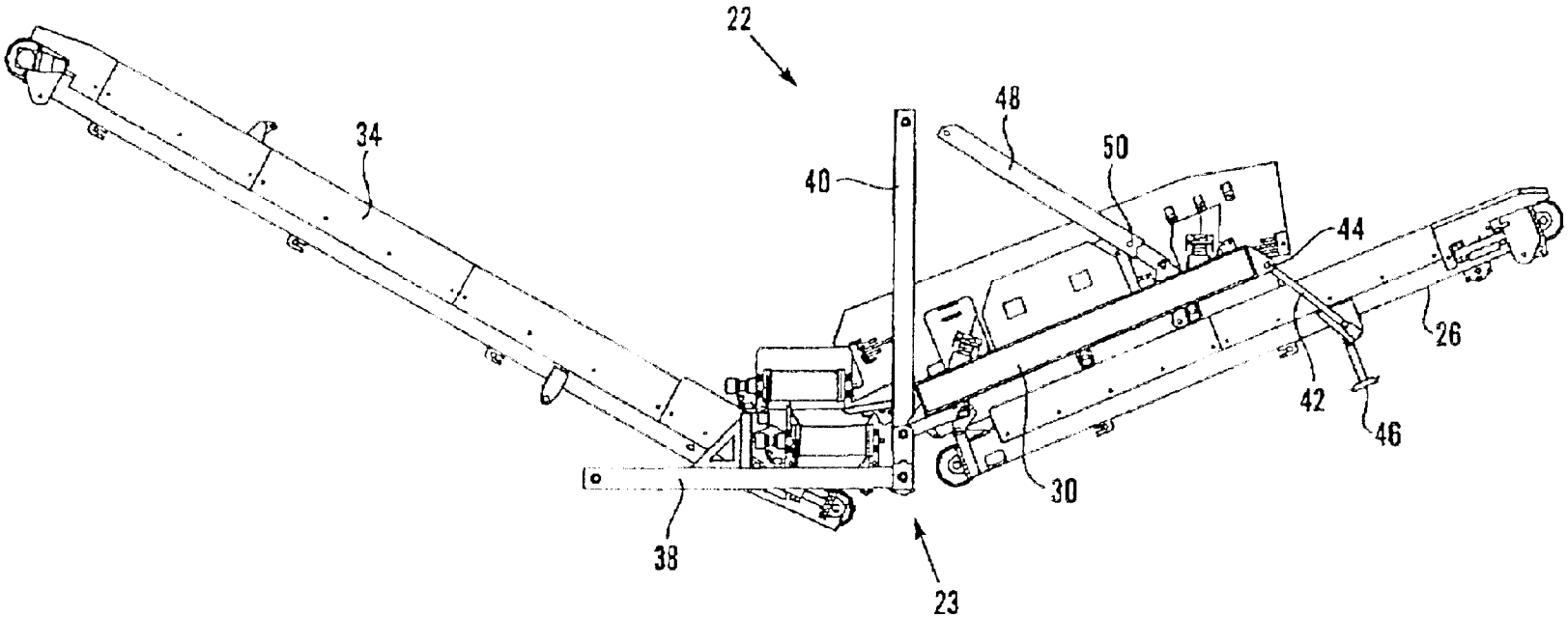
FIG. 2 is diagrammatic side view of part of the mobile crusher shown in FIG. 1.

The screen assembly 22 can be seen more clearly in FIG. 2 which shows the subframe 23 and the communication between the screen assembly 22 and the recirculating conveyor 34.

The subframe 23 consists of a pair of horizontal members 38 and a pair of vertical members 40, only one of either being visible in the drawings. Each horizontal member 38 is securably connected to an associated vertical member 40, to form a substantially right angled truss configuration, as shown. The free end of each horizontal member 38 is securably connected to a lower portion of the chassis 12, and the free end of each vertical member 40 is connected to an upper portion of the chassis 12, in use, as can be seen in FIG. 1.

The frame 30 is pivotably connected to the subframe 23 adjacent the lower end of each vertical member 40. The secondary discharge conveyor 26 is pivotably connected to the underside of the frame 30, and is releasably held in a position substantially parallel to the screen, as shown in FIGS. 1 and 2, by means of a pair of struts 42, only one of which is visible in the drawings. The lower end of each strut 42 is pivotably connected to the secondary discharge conveyor 26 adjacent its free end, to the right as viewed in the drawings. The upper end of each strut 42 is removably secured to the frame 30 by means of pins 44.

A support foot 46 extends transversely across the underside of the secondary discharge conveyor 26, for supporting the screen assembly in a non-operative position, as will be described below.

Figure 3:
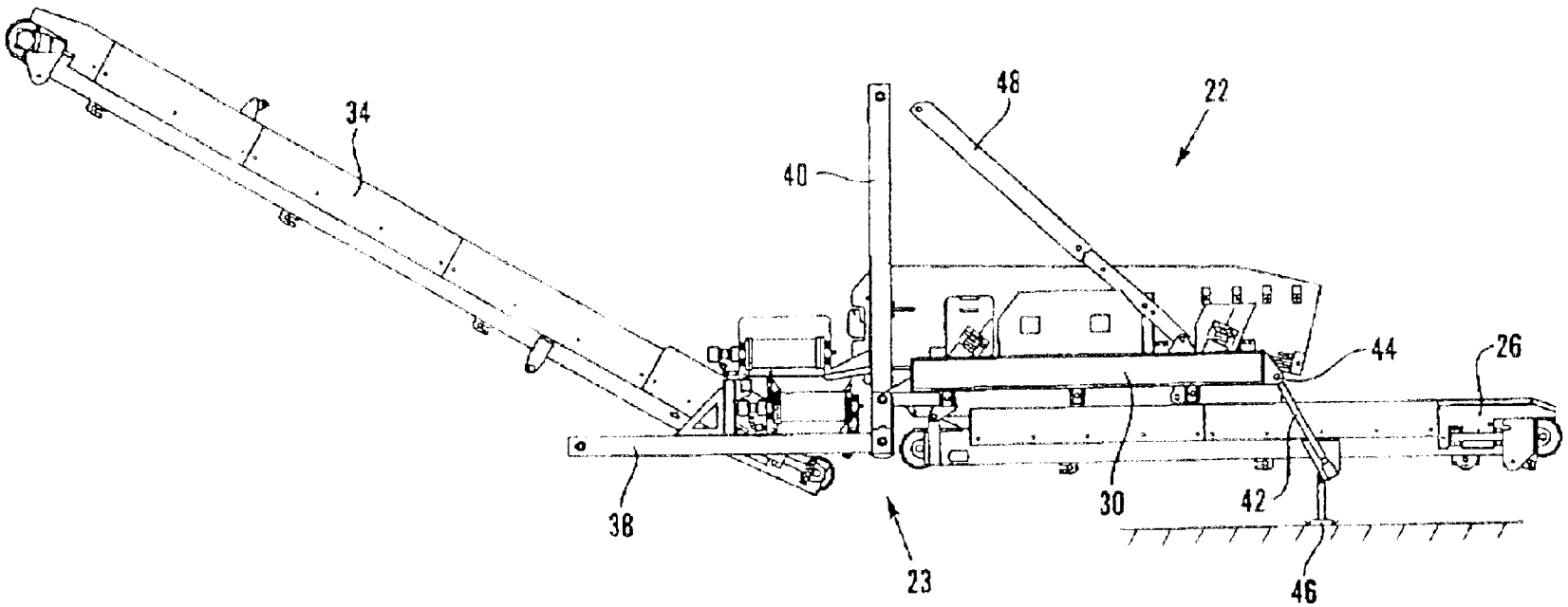
FIG. 3 shows the part of the mobile crusher of FIG. 2, with the screen assembly in a lowered position.

A pair of telescopic tubes 48 are provided on the screen assembly 22, only one of which is visible in the drawings. The lower end of each telescopic tube 48 is pivotably connected to the upper side of the frame 30 adjacent its right hand end, as viewed in the drawings. The upper end of each telescopic tube 48 is pivotably connected to an upper portion of the chassis 12, in use, as can be seen in FIG. 1. The telescopic tubes 48 include internal hydraulic cylinders for selective movement of the tubes 48 between a retracted position (shown in FIGS. 1) and an extended position (shown in FIG. 3). The telescopic tubes are secured in the retracted position shown in FIG. 1 by means of removable pins 50.

In the event that access to the upper side of the mesh is required, e.g. for maintenance, the pins 50 are removed to enable the screen 24 and secondary discharge conveyor 26 to pivot with respect to the crusher 10, clockwise as viewed. The hydraulic cylinders move the telescopic tubes 48 from the retracted position to the extended position of FIG. 3. In this position, the support foot 46 comes into contact with the ground, to support the screen assembly 22. Thus, maximum access to the upper side of the screen 24 is provided between the angle of elevation of the primary discharge conveyor 18, to enable the upper side of the mesh to be dealt with, as required.

Figure 4:
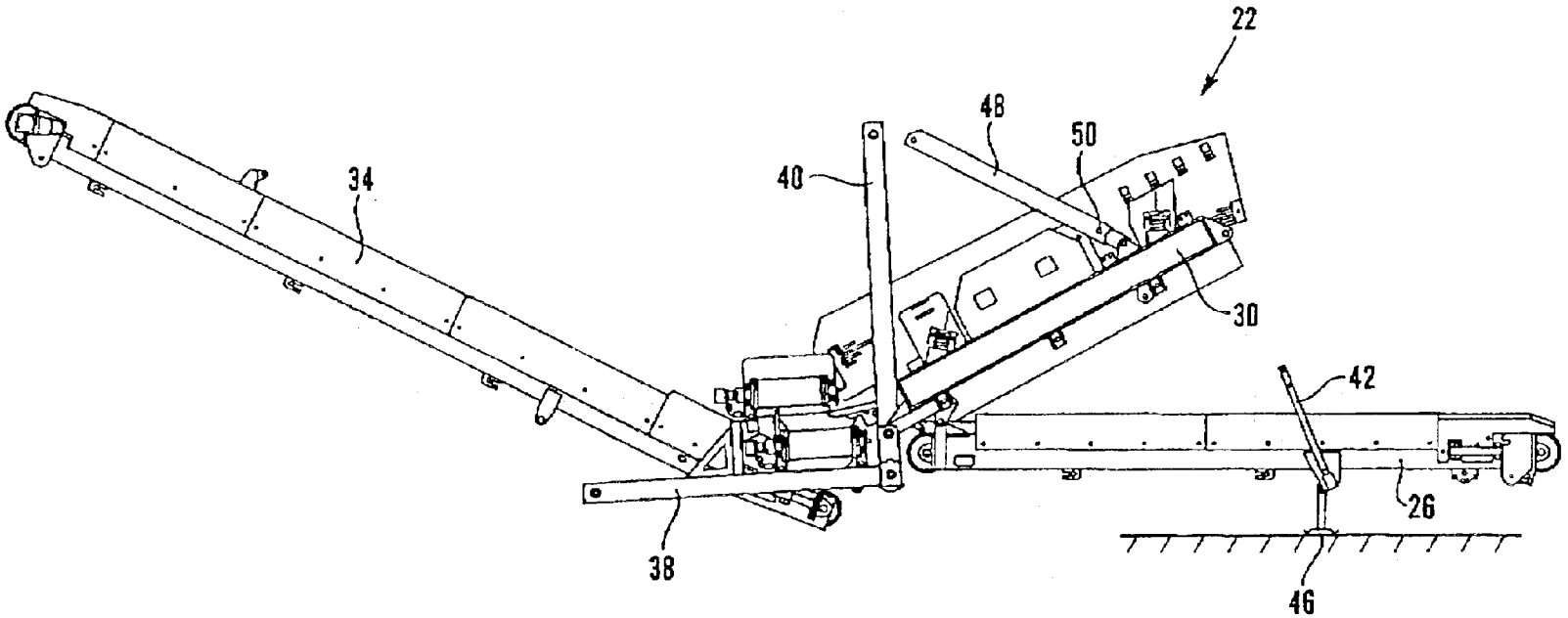
FIG. 4 shows the part of the mobile crusher of FIG. 2, with a conveyor of the screen assembly in a lowered position.

If access to the underside of the mesh is then required, the telescopic tubes 48 are moved to the retracted position and the pins 50 are reintroduced to secure the screen assembly 22 in the position shown in FIGS. 1 and 2. The pins 44 are then removed from the connection between the frame 30 and the struts 42, to enable the secondary discharge conveyor 26 to pivot with respect to the screen 24, clockwise as viewed, to the position shown in FIG. 4. In this position, the support foot 46 comes into contact with the ground, to support the secondary discharge conveyor 26, independently from the screen 24. Thus, the attitude of the conveyor 26 relative to the screen 24 can be altered to allow maximum access to the underside of the screen 24, to enable the underside of the mesh to be dealt with, as required.

Although the screen assembly 22 has been described with respect to a subframe by means of which the screen assembly 22 is mounted on a mobile crusher chassis 12, it will be appreciated that the screen assembly 22 could be adapted to be secured directly on to the chassis of a mobile crusher, without the need for a subframe. For example, the chassis of the mobile crusher could be specially formed to accommodate such a screen assembly 22.

Whilst the invention has been described with respect to a mobile crusher, the invention could also be used on other kinds of material processing plant having a similar construction, such as a wood processing plant having a shredding tool, as opposed to a crushing tool, or any static crushing plant.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A screen assembly for a material processing plant, the assembly comprising:

a screen having a mesh for segregation of fractions of material placed thereon;

a conveyor mounted beneath the screen by a pivot connection, the conveyor having a first end and being movable between i) an operative position in which the conveyor is disposed substantially parallel to the screen or receiving material which is passed through the screen, in use, and ii) an inoperative position in which the conveyor is angularly displaced about the pivot connection before providing access to the underside of the screen; and releasable connection means between the screen and the conveyor in a fixed position relative to the screen in the operative position, and for enabling adjustment of the altitude of the conveyor relative to the screen so as to enable the first end of the conveyor to move away from the screen to the inoperative position.

2. A screen assembly according to claim 1, wherein the pivot connection between the screen and conveyor is provided at respective ends of the screen and conveyor, such that, in the inoperative position, the free ends of the screen and conveyor are displaced away from one another, to allow substantially maximum access to the underside of the screen.

3. A screen assembly according to claim 1, wherein the means for releasably securing the attitude of the conveyor relative to the screen in the operative position consists of at least one connecting member having two ends, one end connected to the conveyor and the other end connected to the screen, and at least one end of the connecting member being releasably connectable to the conveyor or screen respectively.

4. A screen assembly according to claim 1, wherein the means for releasably securing the attitude of the conveyor relative to the screen includes at least one removable pin.

5. A screen assembly according to claim 1, wherein the screen assembly includes means for connecting the screen assembly to a material processing plant.

6. A screen assembly according to claim 5, wherein the screen assembly is pivotably mounted on the means for connecting the screen assembly to a material processing plant, for pivotable movement of the screen assembly relative to the plant, in use.

7. A screen assembly according to claim 5, wherein the means for connecting the screen assembly to a material processing plant includes at least one telescopic member having two ends, one end of the at least one telescopic member being connected to the screen assembly, and the other end of the at least one telescopic member being connectable to the material processing plant, for raising or lowering one end of the screen assembly relative to the plant.

8. A screen assembly according to claim 7, wherein the at least one telescopic member includes a hydraulic cylinder for selectively moving the telescopic member between an extended position and a retracted position.

9. A screen assembly according to claim 1, wherein the screen assembly includes a subframe connectable to a material processing plant, for mounting the screen assembly on the plant.

10. A screen assembly according to claim 1, wherein the underside of the screen assembly includes a support member for supporting the screen assembly in a lowered position, in use.

* * * * *